United States Patent [19]

Barres

[11] Patent Number: 4,790,882

[45] Date of Patent: Dec. 13, 1988

[54] FLUSHING AND RECHARGING METHOD FOR THE COOLING SYSTEM OF AN AUTOMOTIVE ENGINE

[75] Inventor: Michael J. Barres, Jericho, N.Y.

[73] Assignee: Autospa Corporation, Woodside, N.Y.

[21] Appl. No.: 21,643

[22] Filed: Mar. 4, 1987

Related U.S. Application Data

[63] Continuation of Ser. No. 711,859, Mar. 14, 1985, abandoned.

[51] Int. Cl.[4] ..... B08B 9/00

[52] U.S. Cl. ..... 134/22.18; 210/767; 210/167; 123/41.21; 123/41.23; 123/41.55; 134/24; 134/36

[58] Field of Search ..... 210/767, 167; 123/41.21, 41.23, 41.55, 198 R; 134/22.1, 22.11, 22.18, 22.12, 22.19, 24.36; 165/95

[56] References Cited

U.S. PATENT DOCUMENTS 4,161,979 7/1979 Stearns ..... 134/24
4,379,082 4/1983 Stearns ..... 210/223

FOREIGN PATENT DOCUMENTS 735235 5/1966 Canada ..... 134/22.11

*Primary Examiner*—H. M. S. Sneed
*Assistant Examiner*—Sharon T. Cohen
*Attorney, Agent, or Firm*—Abelman Frayne Rezac & Schwab

[57] ABSTRACT

A flushing and recharging system for an automotive engine includes a tee branch inserted in the coolant return hose from the cylinder block of an engine to the radiator, and which is employed to flush and recharge the cooling system with coolant fluid, provision being made for reversing the fluid flow through the return hose, the supply of scavening water optionally being a flow pulsating in pressure and velocity. The waste coolant scavenged from the cooling system is separated out to remove particulate matter and to separate petroleum products from the water base of the coolant fluid.

3 Claims, 1 Drawing Sheet

FLUSHING AND RECHARGING METHOD FOR THE COOLING SYSTEM OF AN AUTOMOTIVE ENGINE

This is a continuation of application Ser. No. 711,859 filed on Mar. 14, 1985, abandoned.

FIELD OF THE INVENTION

This invention relates to a system and method for use in flushing the cooling system of an automotive engine, and for recharging the cooling system with replacement coolant fluid. While not limited thereto, the invention has particular application to the flushing and recharging of the cooling system of an automobile engine of the type having a water cooled cylinder block interconnected through flexible hoses with a fin-tube or other radiator, a water pump being provided to ensure the continuous circulation of coolant fluid through the cylinder block and through the radiator during operation of the engine.

BACKGROUND OF THE INVENTION

The conventional manner of flushing and recharging the coolant system of such an automobile engine historically involves the removal of a closure cap from a filler pipe extending upwardly from a top header of the radiator while the engine is stationary, and then permitting the cooling system to drain by gravity through a stop cock associated with a bottom header of the radiator.

The engine of the automobile cannot be operated during such an operation, in that the engine would overheat and possibly seize during the draining operation, and thus, turbulence cannot be introduced into the coolant during the draining operation, such as is essential to insure the flushing of particulate matter out from the system. Such particulate matter is the product of scaling, flaking, corrosion or the like within the cooling system. Further, as the draining is exclusively through the stop-cock, which itself is of relatively small diameter, the draining of the system by gravity proceeds in an entirely quiescent manner further mitigating against the flushing out of the system of heavier particles of particulate matter.

The coolant fluid of such systems, further, almost without exception is an admixture of water and a petroleum based anti-freeze additive such as ethylene glycol, the waste coolant drained from the system thus constituting a source of pollution in the event that it is discharged directly onto the ground, or, as in common practice, it is discharged directly into a sewer system.

Further, as the coolant fluid is discharged from the system in a relatively quiescent manner, no guarantee can be made that particulate matter that has settled and forms, or potentially forms, a blockage in any part of the system is satisfactorily removed as the coolant fluid as it is discharged from the system.

The drainage of the system by gravity further provides no guarantee that the system has been fully drained, in that pockets filled with coolant fluid can remain within reentrant portions of the cylinder block, and can be trapped in the core of the heating system by air locks, either exclusively or in combination with already existing blockages or partial blockages existing within the system.

The requirement for pressure flushing of the system has been previously recognized, and has been accomplished by pressure flushing the system with a turbulent flow of coolant fluid, which, instead of being discharged from the stop cock associated with the bottom header, is discharged through the relatively large diameter opening of the filler pipe of the upper header.

As the cooling system is at no time emptied of coolant fluid during this procedure, the engine can be operated, as will be the water pump of the engine, thus promoting turbulence within the cooling system, but not necessarily of sufficient intensity to ensure scavenging of larger particles of particulate matter from the cooling system.

In order to introduce the turbulent supply of coolant fluid under pressure, one of the hoses between the cylinder block and the radiator is cut, and a tee fitting is inserted in that location, the supply of replacement coolant fluid under pressure being introduced into the branch of the tee fitting by an appropriate hose supplied from a power driven pump. Subsequent to the flushing operation the supply hose is removed from the branch of the tee fitting and the branch is capped leaving it available for a subsequent flushing operation.

In the flushing of the coolant system in this manner, there still is no guarantee that the entire cooling system will be flushed, in that the supply of flushing coolant fluid will take the path of least resistance between its point of insertion into the cooling system and its escape from the radiator filler tube.

This procedure allows the operation of the engine during the flushing procedure, and thus is far more successful than the previous procedure of gravity draining of the cooling system. However, as in the gravity drainage system, there is no guarantee that stagnant pockets of the cooling system will be flushed, and, that blockages or partial blockages will be removed. This is because the supply of coolant fluid under pressure cannot be constrained or redirected from its flow path of least resistance, and, uniformity of the flow of scavenging coolant fluid under pressure cannot be obtained throughout the entire system for the purpose of removing all existing particulate matter from within the cooling system. This applies particularly to the heating core, which usually is fed by convection in the absence of a separate pump for the coolant fluid heated in the cylinder block.

SUMMARY OF THE INVENTION

It is an object of this invention to provide a system for use in flushing the cooling system of an automotive engine, which will insure that the entire cooling system is flushed with replacement coolant under pressure and in a highly turbulent state, thus minimizing to the greatest possible extent the possibility of blockages or partial blockages remaining within the cooling system.

According to the present invention, the flushing system includes a tee fitting inserted into the return hose of the engine cooling system, and, selectively actuable means positionable on the return hose on the side only of the tee fitting and operative to restrict a flow of coolant fluid introduced through the branch of the tee fitting exclusively to unidirectional flow in one direction through said return hose.

Said selectively actuable means subsequently is positionable on the return hose on the opposite side of said tee fitting to reverse the direction of uni-directional flow through said return hose.

A scavenging supply of coolant fluid is introduced through the branch of the tee fitting through a supply hose detachably attachable to said tee branch. The hose incorporates one-way flow devices which permits flow to said tee fitting and inhibits reverse flow through said supply hose.

Cap means is attachable to said radiator in substitution of the radiator cap thereof, the cap means including a swivel connection to which is attached a transparent viewing means through which the waste coolant fluid flows from the engine to a point of disposal.

The waste coolant fluid discharge through said transparent viewing means is fed directly to a separator in which entrained particulate matter is removed from the waste coolant fluid, and in which water in the coolant fluid is separated from petroleum products entrained in said water, the water then being disposed of in any convenient manner, and the petroleum products then being fed to storage tank for subsequent reprocessing.

Further, according to the present invention, said system incorporates pressure increasing means in the supply of scavenging coolant fluid to said supply hose.

Further, in order to enhance the scavenging action of said pressurized coolant fluid, a pressure pulsing device is included in the supply of coolant fluid to intentionally produce water hammer in the flow of scavenging coolant fluid and in order to produce pressure and velocity surges in said coolant fluid, thus further to enhance removal of particulate matter from the cooling system.

Further, according to the present invention, there is provided a method of scavenging the cooling system of an automotive engine, which includes supplying a scavenging flow of coolant fluid to the cooling system at a point intermediate a radiator and a cylinder block of said automotive engine, successively reversing a unidirectional flow of said scavenging coolant fluid within said cooling system, evacuating said scavenging coolant fluid through the filling cap of the radiator, and subsequently separating out water, particulate matter, and petroleum products entrained in said water from said scavenging supply of coolant fluid.

The method of the present invention optionally further includes the steps of pulsing said scavenging flow of coolant fluid in order further to enhance the scavenging action of said coolant fluid as it progresses through the cooling system.

DESCRIPTION OF THE DRAWINGS

The invention will now be described with reference to the accompanying drawings, which are illustrative of preferred embodiments of the invention, and in which.

Figure 1:
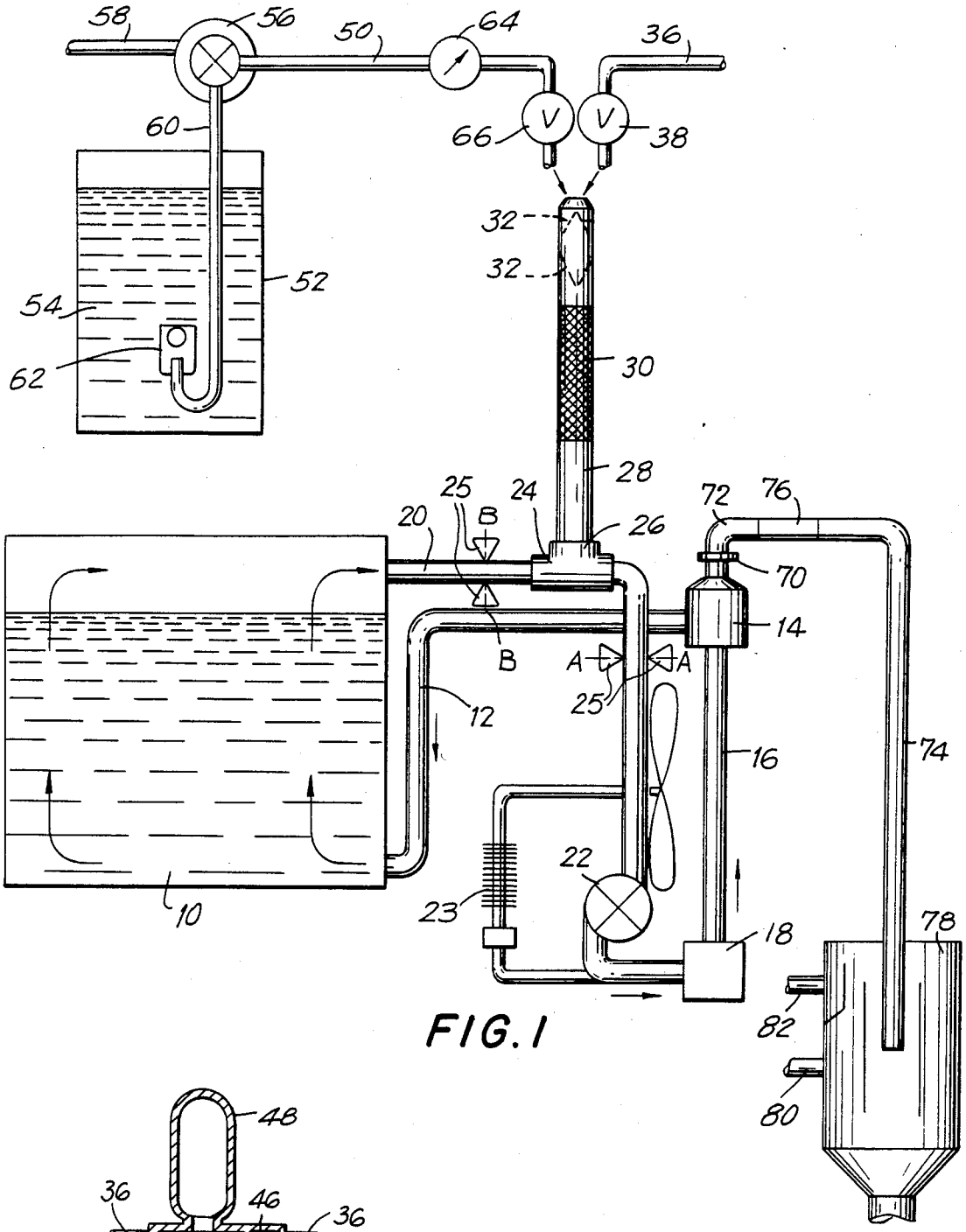
FIG. 1 is a schematic and diagramatic illustration of the system of the present invention shown in conjunction with a diagramatic illustration of an automotive engine; and, FIG. 2 is a diagramatic cross-section through a pulsing device for intentionally introducing water hammer into the supply of flushing coolant fluid.

Referring first to FIG. 1, there is diagramatically illustrated a fluid cooled cylinder block 10 of a conventional automotive engine. Coolant fluid is supplied to the cylinder block by an inlet hose 12 connected to an upper header 14 of a fin tube radiator 16 of conventional construction. Heated coolant fluid is returned to a bottom header 18 of the radiator from the cylinder block 10 via a return hose 20, under the forced feed of a water pump 22, a portion of the heated return flow passing through a heater core 23.

In the event that the automotive engine has not been previously prepared, the return hose 20 is cut at a convenient point along its length, and a tee fitting 24 is inserted between the cut ends, and appropriately secured to the cut ends of the return hose 20, such as by a combination of adhesives and garter clamps (not shown). The tee fitting 24 has a branch 26, which conveniently is threaded either internally or externally, for it to receive either the connector of a supply hose 28, or, a closure cap that can be removed in order to permit subsequent flushing operations.

The tee fitting 24 and its branch 26 is positioned in an upper run of the return hose 20, such that coolant fluid within the system will not drain out of the branch 26 at the time it is open during removal and replacement of either the supply hose 28 or the closure for the branch, provided that the tee fitting can be located above the level of the top header 14.

If the tee fitting 24 cannot be so positioned, then, the system is partially drained to permit insertion of the tee fitting, and, the branch 26 is provided with an appropriate one-way valve inhibiting the escape of coolant fluid at the time the cooling system is recharged. In this event, all that is required is a dust cap for the branch 26 to protect the one way valve when the fitting is not required for use.

The supply hose 26 is any suitable flexible hose, which may be reinforced with wire mesh 30, or alternatively provided with a flexible metal cladding. At its outlet end, the supply hose is provided with any convenient means of quick attachment to the branch 26 of the tee fitting 24, and also is provided with a one way valve (not shown) to prevent fluid from draining from the hose when it is removed from the tee fitting.

At its inlet end, the supply hose 28 is provided with a one-way inlet valve 32 of any appropriate construction to prohibit reverse flow and possible siphoning through the supply hose 28, and also includes a suitable device 34 for increasing the velocity of coolant fluid supplied to the hose. The one way valve 32 and the velocity increasing device 34, conveniently may be incorporated into a single fitting attached to the inlet end of the supply hose 28, and, which provides quick connect capability to alternative supplies of water and anti-freeze compound, as now discussed.

One of the supplies, 36, is a supply of water under pressure, typically, a city water supply at a pressure of 26 or more pounds per square inch. The water supply 36 is provided with a manually actuable control valve 38, and an appropriate quick-connector whereby the supply hose 28 may be connected directly to it.

Figure 2:
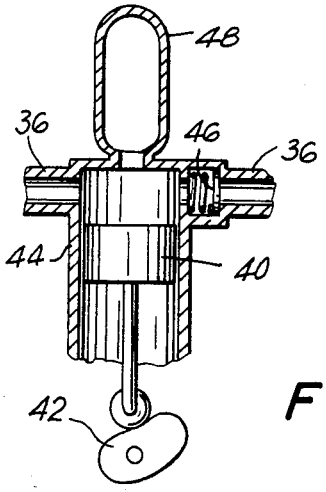

Optionally, and as diagramatically illustrated in FIG. 2, a device can be incorporated into the main supply line 36 for intentionally introducing water hammer into the output of the supply pipe 36. Such a device can incorporate a piston 40 that is reciprocated by a lobe cam 42, and which reciprocates within a cylinder 44. Water is supplied to the cylinder from the mains supply pipe 36 via a one-way valve 46 which opens at times when the pressure existing in the cylinder is less than mains pressure, and, which closes at the time the pressure within the cylinder rises above mains pressure. Conveniently, and in order to produce pulsing, surging, and water hammer in the exiting water, the cylinder is interconnected with a conventional expansion tank. The lobe cam 42 can be rotated by any convenient means, such as by a conventional electric motor.

The other supply pipe 50 is a supply pipe for an anti-freeze compound, such as ethylene glycol, which conveniently is stored in a conventional 55 gallon barrel 52. The anti-freeze compound, indicated at 54, is pumped from its storage barrel by an air-driven pump 56, which is supplied with compressed air via a line 58. The anti-freeze compound 54 is withdrawn from the barrel 52 via a stand pipe 60, provided at its lower end with any convenient form of float valve 62, in order to preclude air from being drawn into the supply pipe 50 in the event that the level of the anti-freeze compound drops below the level of the stand pipe.

Anti-freeze compound delivered via the supply pipe 50 passes through a volume meter 64 calibrated in gallons, and which is positioned upstream of a manually controllable valve 66, the supply pipe 50 terminating in a quick-connect connector identical with the one associated with the water supply pipe 36.

The supply hose 28, thus can be connected at its inlet with equal facility either to the water supply pipe 36, or, to the anti-freeze compound supply pipe 50.

The system also includes a quick-connect adaptor cap 70 for connection with the inlet of the upper header 14 of the radiator, the adaptor cap including a right-angled swivel 72 permitting it to extend to either side of an automobile, in accordance with convenience.

Connected to the swivel 72 is a waste hose 74, which either is formed of a transparent material, such as transparent vinyl, or, which has interposed therein a length of transparent tubing 76, conveniently of a transparent acrylic material. As the waste output from the radiator is at very low pressure, relatively low strength materials can be employed for the waste hose 74 and the transparent tubing 76, if such is provided.

The waste hose 74, which normally would be exited into a drain of a city sewer system, instead is connected to a separator 78 of any convenient construction, such as a gravity separator, or a cyclonic or centrifugal separator, within which particulate matter is sedimented out for disposal as waste sludge, and, the water and the entrained petroleum products, namely the anti-freeze compound, are separated out and discharged separately through a waste water pipe 80, and through a recovered anti-freeze compound pipe 82. The waste water at this time is conveniently discharged into a city sewer, while the recovered anti-freeze compound is fed to a storage tank for collection and subsequent re-processing.

In operation of the system of the present invention, the supply hose 28 is connected to the tee branch 26 and also to the water supply line 36. The waste hose 74 is then connected to the upper header 14 of the radiator by use of the adaptor cap 70, and the valve 38 is then opened to commence flushing of the cooling system of the engine with water from the supply pipe 36.

At this point, the engine 10 is started, thus operating the water pump 22, and, the controls of the heater core 23 are set to maximum.

The flushing operation is then continued, preferably in excess of three minutes, with the engine operating at substantially constant idling speed, or, if desired, with the engine being pumped to produce surges in engine speed. This initial step serves to remove used and contaminated coolant fluid from the cooling system, which can be observed through the transparent waste hose 74, or, through the transparent viewing tube 76.

The engine is then stopped, and a compression clamp is applied to the return hose 20 at one side of the tee fitting 24, as indicated by the chain line A—A. So doing stops the flow of scavenging water towards the lower header 18 of the radiator, and in turn directs the entire flow of scavenging water through the cylinder block, thus substantially increasing the velocity and turbulence of the scavenging water supply within the cooling system. This procedure is continued for three or more minutes, again observing the clarity of the waste coolant fluid through either the transparent waste hose 74, or, the transparent viewing tube 76.

The compression clamp may be of any convenient form, and conveniently is an overset toggle clamp having substantially parallel jaws that are moved towards each other under the action of an overset toggle mechanism, which conveniently includes a ratchet mechanism.

The compression clamp is then removed from the location A—A, and is repositioned on the return hose 22 at the opposite side of the tee fitting 24 at the location B—B, in order to preclude scavenging water flow through the cylinder block. The entire flow of scavenging water is in this manner reversed through the heater core and through the radiator 16.

As the water pump 22 is stopped, the major flow will be through the heater core in reverse flow to that normally produced by the pump 22. This procedure is then continued for three minutes or more, until such time as the waste water observed in the waste line 74, or in the transparent tube 76 becomes clear.

The supply line 28 is then disconnected from the water supply line 36, and, is reconnected to the anti-freeze compound supply line 50.

At this time, the entire cooling system of the automotive engine is fully charged with clear water, free of comtaminants and sediments.

One gallon of full strength anti-freeze compound is then pumped into the cooling system. The hose clamp is then moved from its position B—B to the position A—A, and a further one gallon of anti-freeze compound is pumped into the system. The hose is then removed, the engine started, and a further one gallon of anti-freeze compound is pumped into the cooling system of the automotive engine, this making the full compliment of anti-freeze compound normally required in such a system.

The supply hose 28 is then removed from the branch 26 of the tee fitting 24, and, the adaptor cap 70 is removed from the radiator and replaced by a conventional radiator cap.

After the engine has been run for several minutes, the specific gravity of the coolant fluid is checked in the usual manner, and, any appropriate additions of water or anti-freeze compound made to the system.

As will be appreciated, various modifications in the system and in the method of employing the system may be made within the scope of the appended claims.

What I claim is:

1. A method of scavenging a normally closed cooling system of an automotive engine with a flow of flushing water under pressure separate from said cooling system, said cooling system containing a coolant fluid, and including a radiator including upper and lower headers, flexible conduits connecting said upper and lower headers to a cylinder block of said engine, a water pump interposed in a said conduit interconnecting said lower header and said cylinder block, and a heater core connected in parallel with said water pump, including the sequential steps of:

opening a discharge opening of said upper header and introducing said flushing water into said conduit interconnecting said lower header and said cylinder block, and at a position intermediate said cylinder block and said water pump, and, operating said engine and said associated water pump of said engine;

discharging admixed flushing water and coolant fluid of said cooling system, together with entrained particulate matter scavenged from said cooling system, through said opening of said upper header of said radiator of said cooling system;

subsequently discontinuing operation of said automotive engine, and thus discontinuing operation of said associated water pump;

applying clamping means to said conduit associated with said lower header and at a position intermediate said water pump and said position of introduction of said flushing water into said conduit, to restrict the flow of flushing water under pressure to a back-washing reverse flow thereof through said cylinder block of said engine and through said upper header, in order to scavenge remaining particulate matter from within said cylinder block, and discharging said flushing water and entrained particulate matter through discharge opening of said upper header of said radiator;

removing said clamping means and reapplying said clamping means to said conduit associated with said lower header and at a position intermediate said cylinder block and said position of introduction of said flushing water to restrict said flow of flushing water under pressure to a flow through said heater core of said engine and said radiator in a series flow relationship, and employing said water pump of said engine as an impedance to back flow through said water pump, and, discharging said flushing water and said entrained particulate matter through said discharge opening of upper header of said radiator.

2. The method of claim 1, including the steps of pulsing said flow of flushing water to enhance the scavenging action thereof as said flushing water progresses through said cooling system.

3. The method of claim 1, including the step of deliberately inducing water hammer into said flow of flushing water to enhance the scavenging action thereof as said flushing water progresses through said cooling system.

* * * * *